United States Patent [19]

Rossopoulos

[11] Patent Number: 4,470,713

[45] Date of Patent: Sep. 11, 1984

[54] WRITING HEAD

[75] Inventor: Stéphane Rossopoulos, Yverdon, Switzerland

[73] Assignee: Hermes Precisa International S.A., Yverdon, Switzerland

[21] Appl. No.: 416,678

[22] Filed: Aug. 30, 1982

[30] Foreign Application Priority Data

Sep. 18, 1981 [CH] Switzerland ..... 6038/81

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS 4,010,835 3/1977 Martin et al. ..... 400/124

FOREIGN PATENT DOCUMENTS 2057961 6/1971 Fed. Rep. of Germany ..... 400/124

2810145 9/1978 Fed. Rep. of Germany ..... 400/124

*Primary Examiner*—Paul T. Sewell

*Attorney, Agent, or Firm*—Emory L. Groff, Jr.

[57] ABSTRACT

The needle writing head comprises a support in two parts (5 and 6), each comprising recesses (15, or 18) forming guide paths for needles (16) located along two rows. The part (6) is movable parallel to the row of needles (16) over a distance equal to one-half of the distance between centers of the needles (16) so as to make it possible to place the needles of the second row in alignment or staggered in relation to the needles of the first row. Means (19 to 26) consist of notching means to fix the two relative positions of the parts (5 and 6).

The latter (5 and 6) are rubies and the part (5) is in two parts (12and 13) glued at (14).

2 Claims, 2 Drawing Figures

WRITING HEAD

Needle type writing heads comprising at least two rows of needles are already known. The needles are mounted to slide in guide paths in a support comprising two parts, with the two rows being arranged approximately vertically in relation to the direction of writing of a line by the head. Means are provided to make it possible at will to produce a relative movement between the two parts of the support to align the positions of the needles of one row in relation to the positions of the needles of another row parallel to the direction of writing, or to stagger these positions between the two rows (see U.S. Pat. No. 4,010,835).

The object of this invention is to provide a needle head of this type whose construction is very precise while being simple to make.

For this purpose, the writing head according to the invention is characterized by the fact that the two parts of the support are provided with two faces placed opposite each other, one of these faces having recesses parallel to each other and with an approximately semicircular section, with a radius corresponding to that of the needles and making it possible for the needles to slide freely, the needles of a row being placed in these recesses and retained therein by a hollow portion of the other part, the hollow portion having a length approximately equal to the length of this row of needles.

The accompanying drawing diagrammatically shows, by way of example, an embodiment of the writing head, which is the object of the invention.

The writing head shown comprises a support 1 formed by two parts 2 and 3, part 2 being solid with the writing head which is not shown, since it is well known in itself. Part 3 is mounted to slide on part 2.

Figure 3:
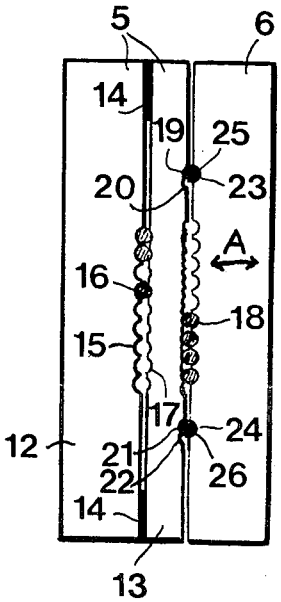
FIG. 3 is a view on a larger scale of the support providing the guide paths for the needles.

This support is provided with guide paths for two rows of needles, these paths being made of an industrial ruby 4 which is shown on a larger scale in FIG. 3 and which comprises a fixed part 5 and a movable part 6, the latter being mounted on sliding part 3.

The guiding of part 3 on part 2 is provided by two small tongues 7 and 8 of part 2 which are inserted into two recesses 9 and 10 of part 3. The latter also carries a pin 11 intended to control its movement in relation to part 2.

As FIG. 3 shows, part 5 of ruby 4 itself consists of two parts 12 and 13 assembled by gluing at 14.

Part 5 has a series of nine parallel recesses 15 with an approximately semicircular section and forming guide paths for needles 16 of a first row of needles.

Part 13 also has a series of parallel recesses 17 located opposite recesses 15 whose section is curved so as to fit the circular section of needles 16, while allowing a play of a few hundredths of a millimeter to allow a free sliding of needles 16 in their respective guide path.

Guide paths are made between part 13 and part 6 to receive a second row of needles 18. The needles of this second row can be moved as a unit vertically in reference to FIG. 3 to be moved so as to be staggered in relation to needles 16 of the first row, taking into account the writing direction A. By a movement of part 3 downward, over a distance corresponding to half of the pitch of needles 16, i.e., of the distance between the axes of two contiguous needles, needles 18 can be brought into a position aligned with needles 16 in direction A. As is well known, a rapid writing position is obtained when needles 16 and 18 are aligned, since it is possible on the same line per unit of time, to make a number of points double the case where only a single row of needles is available.

In the staggered position of needles 16 and 18, the writing speed remains the same as if there were only a single row of needles, but the quality is better since it is possible to obtain an overlapping of the points drawn by the needles and therefore to make continuous lines.

The two respective positions between parts 2 and 3 of the support are fixed by notched means made between parts 5 and 6 of ruby 4. These means consist of two groups of two grooves 19, 20, 21, 22 parallel to each other and parallel to recesses 15. The bottoms of grooves 19 and 20 and 21 and 22, respectively, are separated from each other by a value equal to one-half of the space between the axes of recesses 15. Each group of two grooves is located opposite a groove 23, or 24, approximately semicircular, of the same radius as that of recesses 15 and used as housing for a rod 25 or 26. These rods are glued in grooves 23 and 24 and have a diameter corresponding to that of needles 16 and 18, increased by the play provided to make free sliding of the latter possible.

Figure 1:
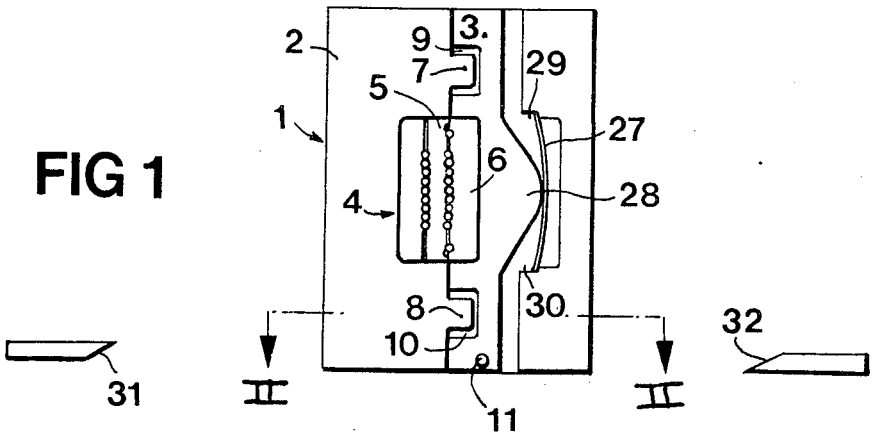
FIG. 1 is a view of the active face of the writing head.
Figure 2:
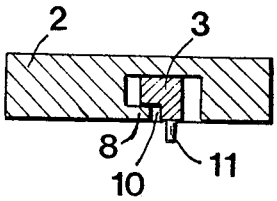
FIG. 2 is a section along line II—II of FIG. 1.

With reference to FIG. 1, part 3 of the support is pushed in the direction of part 5 of the ruby by a leaf spring 27 resting against a boss 28 of part 3 and whose free ends rest in housings 29 and 30. The action of this spring exerts pressure on rods 25 and 26 against the bottom of grooves 19 to 22.

In needle printers, it is customary for the writing head to move along a cylinder on which the writing sheet is placed, this movement being limited at each of its ends by stops that fix the margins of the lines of writing. This arrangement can be used to perform the positioning of the movable row comprising needles 18.

For this purpose, all that is required is to use the customary device for going beyond the margins to bring pin 11 in contact with one or the other of two ramps 31 and 32, respectively, located at each end of the line of writing. The cooperation of pin 11 with ramp 32 brings part 3 into a high position, whereas its cooperation with ramp 31 brings it into a low position.

Of course, numerous modifications to the writing head described can be made. In particular, more than two rows of needles can be provided, the vertical movements of the movable rows being smaller as the number of rows is increased.

The moving and notching means of part 3 can be varied to a great extent, the movements of movable part 3 being able, for example, to be controlled by an electromagnet attached to the writing head.

I claim:

1. A needle writing head, comprising at least two rows of needles, a support comprising two parts, guide paths in said support, said needles slidably mounted in said guide paths, said rows placed approximately vertically in relation to the direction of writing of a line by said writing head, means making it possible at will to produce a relative movement between the two parts of the support to align the positions of the needles of one row in relation to the positions of the needles of another row parallel to the direction of writing, or to stagger said positions between the two rows, wherein said two parts of the support are provided with two faces located opposite each other, one of said faces having recesses parallel to each other and of approximately semicircular section with a radius corresponding to the radius of said needles and making it possible for said needles to slide freely, the needles of one row being placed in said recesses and held therein by a hollow portion of the other part, said hollow portion having a length approximately equal to the length of said row of needles, a spring pushing said two parts of the support toward each other and urging said faces against one another, notching means provided between said two faces to determine the two operating positions, said notching means comprising two groups of two grooves parallel to each other and parallel to said recesses, the bottoms of said grooves of one group being separated from one another by a value equal to one-half of the space between the axes of the semicircular recesses, each of the groups of two grooves located opposite a groove of an approximately semicircular section having the same radius as the radius of said recesses, and a rod of a diameter corresponding to that of the needles, increased by the play provided to make the free sliding of said needles possible, said rod being housed in each groove of semicircular section.

2. A needle writing head according to claim 1, wherein said support comprises rubies and is formed in three parts of which two are held firmly together and are provided with two faces opposite one another, each of said two faces having recesses parallel to each other and provided with a semicircular section of the same size as the recesses provided in a face of said two parts movable in relation to one another.

* * * * *